US011353297B2

(12) United States Patent
Yamamoto

(10) Patent No.: US 11,353,297 B2
(45) Date of Patent: Jun. 7, 2022

(54) TORCH

(71) Applicant: SHINFUJI BURNER CO., LTD, Aichi (JP)

(72) Inventor: Hiroshi Yamamoto, Aichi (JP)

(73) Assignee: SHINFUJI BURNER CO., LTD., Aichi (JP)

( * ) Notice: Subject to any disclaimer, the term of this patent is extended or adjusted under 35 U.S.C. 154(b) by 34 days.

(21) Appl. No.: 16/768,172

(22) PCT Filed: Nov. 26, 2018

(86) PCT No.: PCT/JP2018/043332
§ 371 (c)(1),
(2) Date: May 29, 2020

(87) PCT Pub. No.: WO2019/107300
PCT Pub. Date: Jun. 6, 2019

(65) Prior Publication Data

US 2020/0292281 A1 Sep. 17, 2020

(30) Foreign Application Priority Data

Dec. 1, 2017 (JP) ..... JP2017-231590
Jan. 19, 2018 (JP) ..... JP2018-007361

(51) Int. Cl.
*F42B 4/26* (2006.01)
*F21L 17/00* (2006.01)
(Continued)

(52) U.S. Cl.
CPC ..... *F42B 4/26* (2013.01); *F21L 17/00* (2013.01); *F23D 14/38* (2013.01); *F23D 14/465* (2013.01); *F23D 2203/107* (2013.01)

(58) Field of Classification Search
CPC .... F42B 4/26; F21L 7/00; F21L 26/00; F23D 14/465; F23D 14/18; F23D 2203/107
(Continued)

(56) References Cited

U.S. PATENT DOCUMENTS 2,073,448 A 3/1937 Fruth et al.
4,315,732 A * 2/1982 Rowbottam ..... F23D 14/28 431/255
(Continued)

FOREIGN PATENT DOCUMENTS

CN 1161426 10/1997
CN 101354133 1/2009
(Continued)

OTHER PUBLICATIONS

International Preliminary Report on Patentability dated Jun. 2, 2020 in International (PCT) Patent Application No. PCT/JP2018/043332.
(Continued)

*Primary Examiner* — Steven B McAllister
*Assistant Examiner* — Daniel E. Namay
(74) *Attorney, Agent, or Firm* — Wenderoth, Lind & Ponack, L.L.P.

(57) ABSTRACT

A torch includes a main burner that produces a flame; a flame holding body configured to maintain the combustion state of the main burner if the flame produced by the main burner is about to be extinguished; and a gas supply pipe configured to feed combustion gas from a gas container filled with the combustion gas to the main burner and the flame holding body.

17 Claims, 13 Drawing Sheets

(51) Int. Cl.
*F23D 14/46* (2006.01)
*F23D 14/38* (2006.01)

(58) Field of Classification Search
USPC ..... 431/268, 281; 126/401, 234, 235
See application file for complete search history.

(56) References Cited

U.S. PATENT DOCUMENTS

| | | | | | |
|---|---|---|---|---|---|
| 5,810,577 | A * | 9/1998 | Ledjeff | F23C 6/045 | 431/170 |
| 5,898,013 | A | 4/1999 | Mifune et al. | | |
| 5,902,101 | A * | 5/1999 | Palmer | F21L 17/00 | 431/202 |
| 6,663,258 | B1 * | 12/2003 | Kanter | F21L 17/00 | 362/157 |
| 9,279,583 | B2 * | 3/2016 | Pisklak | F23D 3/40 | |
| 2003/0211435 | A1 | 11/2003 | Long | | |

FOREIGN PATENT DOCUMENTS

| | | | | |
|---|---|---|---|---|
| GB | 543157 | A * | 2/1942 | F21L 17/00 |
| JP | 63247517 | A * | 10/1988 | F23D 14/18 |
| JP | 01-234708 | | 9/1989 | |
| JP | 05231622 | A * | 9/1993 | F23D 14/18 |
| JP | 10-238722 | | 9/1998 | |
| JP | 11-162203 | | 6/1999 | |
| JP | 2000-106003 | | 4/2000 | |

OTHER PUBLICATIONS

International Search Report dated Jan. 29, 2019 in International (PCT) Patent Application No. PCT/JP2018/043332.
Extended European Search Report dated Jul. 16, 2021 in corresponding European Patent Application No. 18882978.2.

* cited by examiner

TORCH

TECHNICAL FIELD

The present invention relates to a torch having the capability of preventing a flame due to combustion of gas from being extinguished by wind and/or rain.

BACKGROUND ART

For a torch used in Olympic and Paralympic torch relays, the mixture ratio of gas and air is adjusted such that the flame produced will be of a color that can be clearly seen even in the daylight, such as red or orange. A flame adjusted in this manner flickers while the torch runner is running, making the relay event more dramatic, but this torch has a disadvantage in that such a flame is weak in power compared with a blue flame, which indicates complete combustion, so that such a flame can be easily extinguished by wind and/or rain. In other words, it was difficult for such a conventional torch to meet the requirement for increased dramatic impact by flame and simultaneously meet the requirement for minimizing the possibility of the flame being extinguished by wind and/or rain.

In order to prevent the flame from being extinguished by wind and/or rain, JP H11-162203A proposes a torch including a windshield portion disposed to surround the flame produced by combustion (see, for example, paragraph 0039 and FIG. 1 of JP H11-162203A). The below-identified JP 2000-106003A proposes a torch including a cylindrical member formed with gas outlet ports and provided with an annular windshield portion and windshield member (see, for example, paragraphs 0049-0051 and FIG. 3 of JP 2000-106003A.

Since the torch disclosed in either of JP H11-162203A and JP 2000-106003A includes a windshield portion that surrounds and covers the flame, the windshield blocks the view of a portion of the flame, thus lessening the dramatic impact by the flame. Further, the provision of the windshield portion increases the weight and size of the torch, which could create problems during the torch relay. Moreover, while these windshield portions can effectively protect the flame from rain falling from above the torch, they may not be effective in protecting the flame from sideways wind and rain.

An object of the present invention is to ensure dramatic impact by the flame, while ensuring that the flame is prevented from being extinguished by wind and/or rain.

SUMMARY OF THE INVENTION

In order to achieve this object, the present invention provides a torch comprising a main burner that produces a flame; a flame holding body configured to maintain a combustion state of the main burner if the flame produced by the main burner is about to be extinguished; and a gas supply pipe configured to feed combustion gas from a gas container filled with the combustion gas to the main burner and the flame holding body.

With this arrangement, the flame holding body keeps the combustion state of the main burner even if the flame produced by the main burner is about to be extinguished by wind and/or rain, thereby eliminating the necessity for a windshield which covers the flame. By omitting a windshield that hides a portion of the flame, the torch relay event becomes more dramatic.

In this arrangement, the flame holding body preferably includes a catalyst that produces catalytic combustion of gas. Catalytic combustion is an event that occurs when a fuel such as gas acts on a catalyst heated to a predetermined temperature or more, and is one of flameless combustion events. Catalytic combustion is maintained as long as the catalyst temperature is maintained at the predetermined temperature or higher, and is least likely to be extinguished by wind and/or rain. Thus, due to such catalytic combustion, the flame holding body is capable of stably maintaining the flame of the main burner. Catalytic combustion may accompany strong light emission depending on the kind of the catalyst used and the catalytic temperature, and such strong light emission will enhance the dramatic effect of the torch relay event.

If a catalyst is used, the catalyst preferably contains at least one of platinum, palladium, ruthenium, rhodium and silver. Which one or ones of these catalysts to use may be determined by the kind of the gas used (butane, propane, etc.).

In any of the above-described arrangements, the flame holding body preferably has a gas discharge port formed by a mesh having openings of 0.01 mm or more and 2 mm or less in size. Such a mesh prevents rainwater that may reach the gas discharge port of the flame holding body from entering the gas discharge port, due to the surface tension of the rainwater. This allows stable combustion by the flame holding body. The reason why the openings of the mesh is preferably within the above-defined range is because, if they are smaller than 0.01 mm, gas cannot be smoothly discharged through the gas discharge port, and if the openings are larger than 2 mm in size, water can easily enter the gas discharge port.

In any of the above arrangements, the gas discharge port of the flame holding body preferably has a three-dimensional shape. By employing a three-dimensional shape, even if horizontal wind in one direction toward the flame holding body partially stops combustion of the flame holding body at its windward side, the combustion is not impacted by the wind, and maintained, at the leeward side of the flame holding body. The three-dimensional shape thus prevents the combustion by the flame holding body from being stopped altogether by wind. The three-dimensional shape may be, for example, a dome, a cylinder, or a cone.

In any of the above-described arrangements, the torch may further include a first intake pipe for feeding gas to the main burner, and the first intake pipe preferably includes, at an end thereof connected to the main burner, a small diameter portion of which the cross-section perpendicular to the gas flow direction in the first intake pipe is smaller in area than the corresponding cross-section of the remaining portion of the first intake pipe. By the provision of the small diameter portion, the flow speed of gas increases in the small diameter portion, of which the cross-sectional area is smaller than the remaining portion of the first intake pipe, and the gas is discharged through the burner ports of the main burner 11 while maintaining its high flow speed. Thus, during a torch relay in a rainy weather, rainwater that may reach the main burner 11 is blown away by the gas discharged through the burner ports 14 at high speed, thereby preventing the flame from being extinguished by the rainwater.

In any of the above-described arrangements, preferably, the gas feed pipe is connected to the first intake pipe for feeding gas to the main burner, and to a second intake pipe that feeds gas to the flame holding body, such that mixtures of gas and air having different gas concentrations can be fed to the main burner and the flame holding body, respectively.

With this arrangement, it is possible to feed, to the main burner, a gas-air mixture of which the air content is lower to produce a red or orange flame, and feed, to the flame holding body, a gas-air mixture of which the air content is higher. In other words, it is possible to create optimum combustions states both for the main burner and the flame holding body.

According to the present invention, by the provision of the flame holding body in addition to the main burner for producing a flame, the flame holding body maintains the combustion state of the main burner. This eliminates the necessity for a windshield which covers the flame and thus tends to lessen the dramatic impact by the flame.

DETAILED DESCRIPTION OF THE INVENTION

Figure 1:
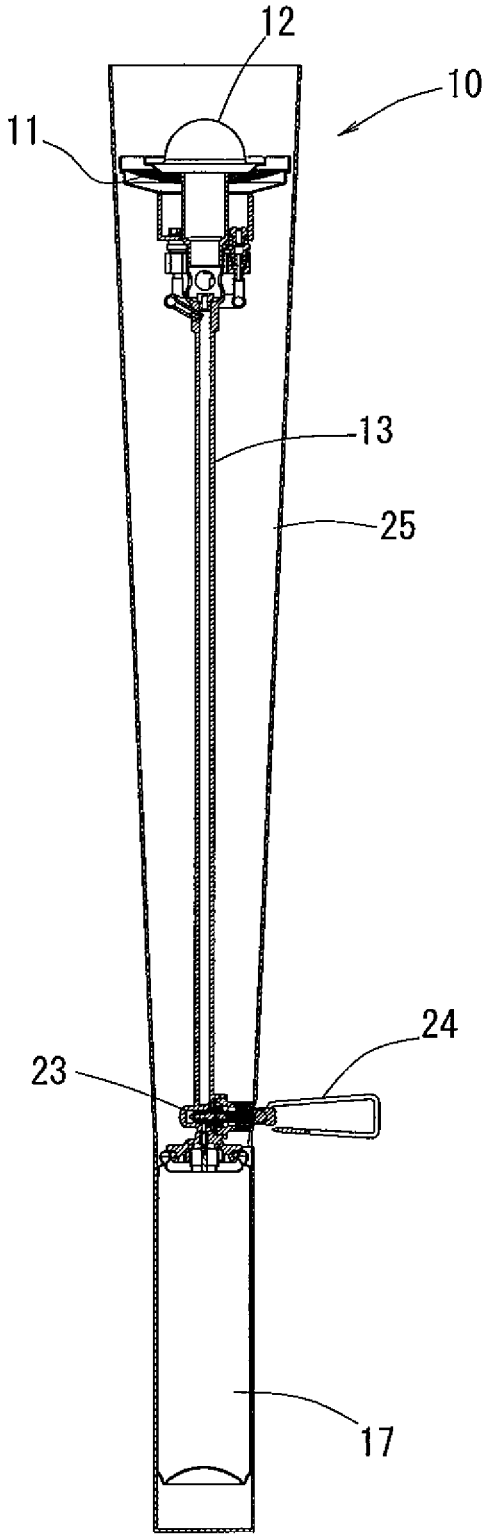
FIG. 1 is a sectional view of a torch according to a first embodiment of the present invention.
Figure 2:
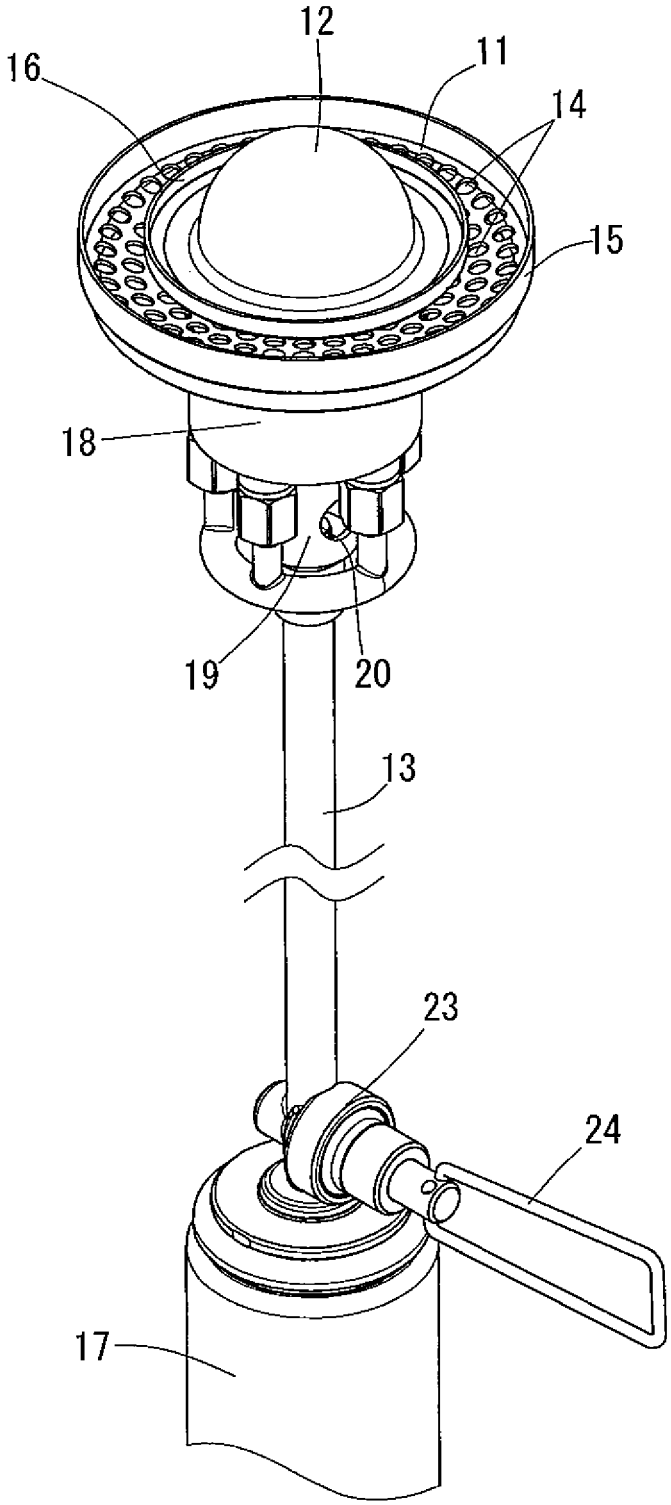
FIG. 2 is a perspective view of the torch shown in FIG. 1, illustrating the interior structure thereof.
Figure 3:
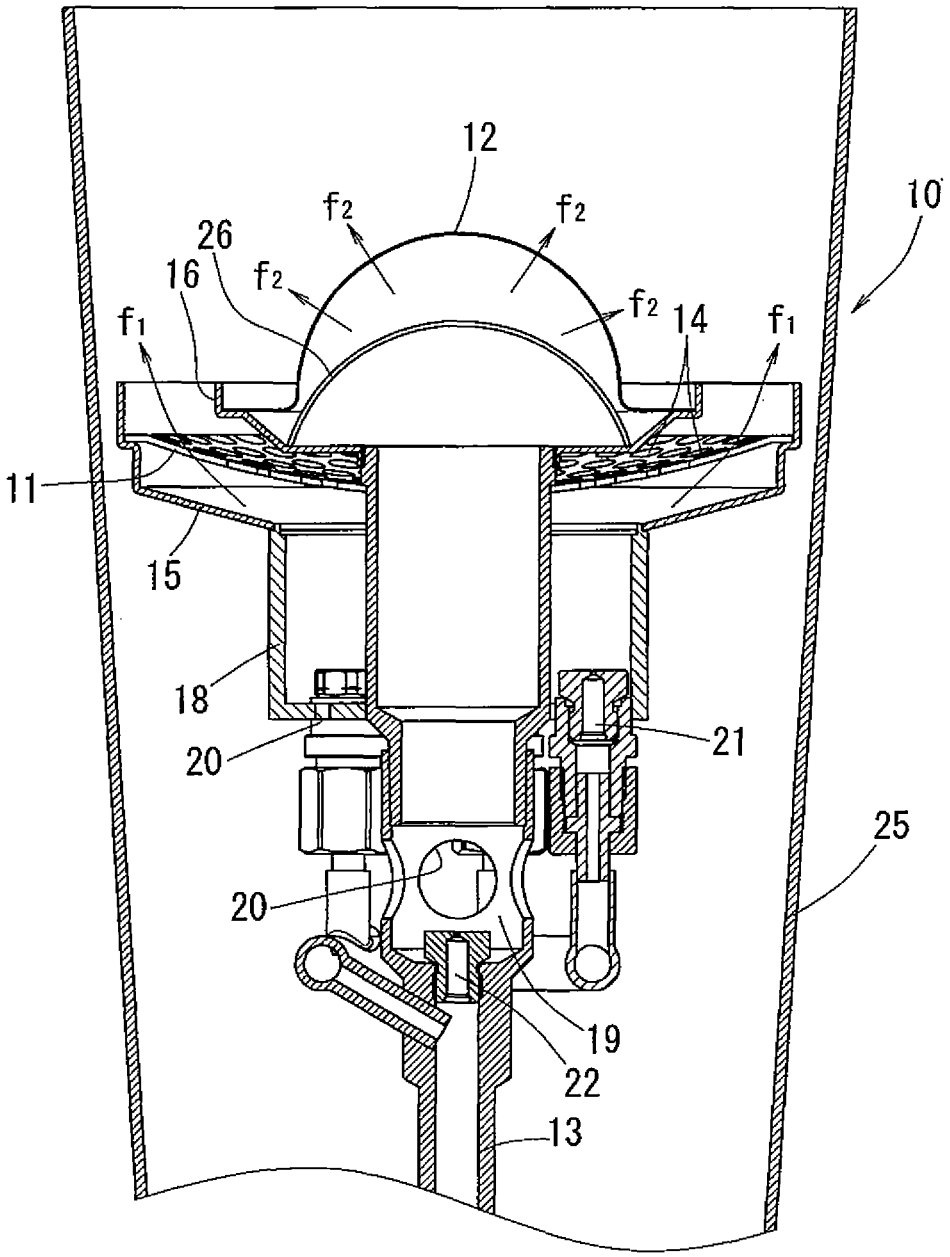
FIG. 3 is a sectional view of a portion of the torch shown in FIG. 1.
Figure 4:
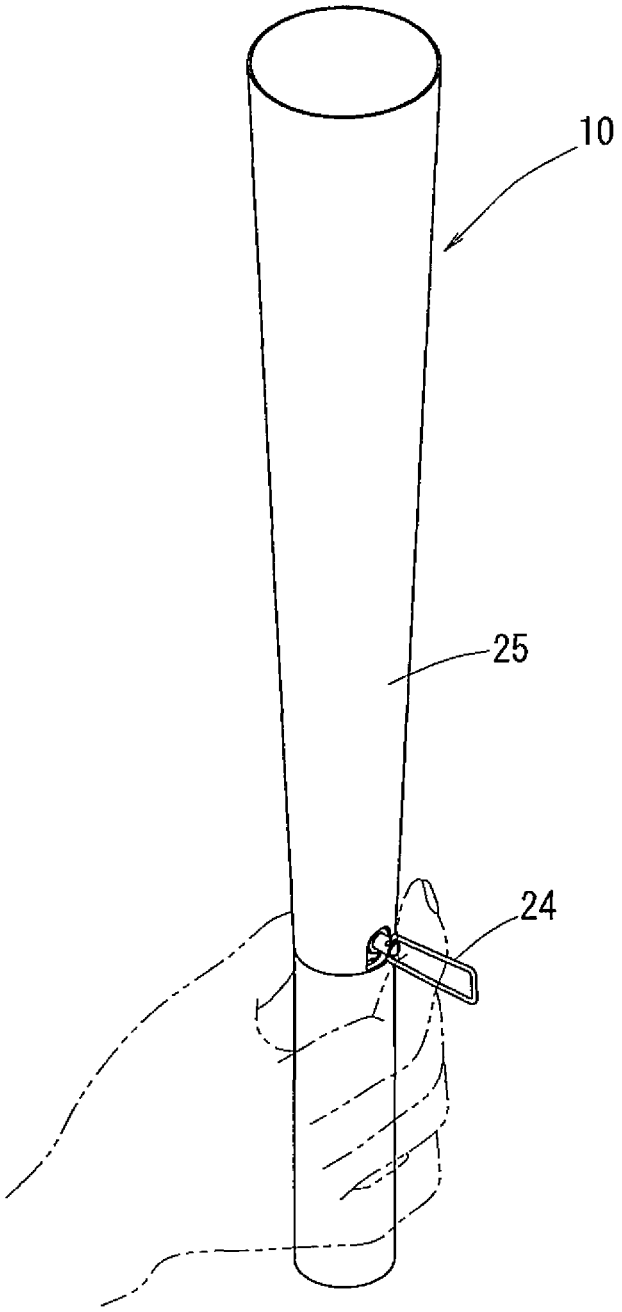
FIG. 4 is a perspective view of the torch shown in FIG. 1, illustrating how it is used.

FIGS. 1 to 3 show the torch 10 according to the first embodiment of the present invention. This torch 10 is intended for use in Olympic and Paralympic torch relays, and includes, as main components, a main burner 11, a flame holding body 12, and a gas supply pipe 13.

The main burner 11 is formed with a through hole at its center, and configured to produce a flame that rises high (so that spectators can see it). The main burner 11 is formed with a plurality of burner ports 14 through which a gas-air mixture is discharged (see arrows $f_1$ in FIG. 3). The main burner 11 is held in position by a main burner holder member 15. A gap is defined between the main burner 11 and the main burner holder member 15, and this gap serves as a gas flow passage through which the gas-air mixture flows.

This torch 10 is required to produce, not a blue flame, which indicates complete combustion, as required for ordinary burners, but a flame of a color that is more clearly seen in the daylight, such as red or orange. To this end, the gas-air mixture ratio of the gas-air mixture supplied to the main burner 11 is adjusted such that the combustion is slightly incomplete. Also, various parameters of the torch 10, including the size of the injection ports of first nozzles 21. (described later), flow rate of the gas-air mixture, and the number and sizes of the burner ports 14, are determined such that a flame rises from the main burner 11 to the height of about 25 to 30 cm.

The flame holding body 12 serves as a pilot burner that maintains the combustion state of the main burner 11 even if the flame of the main burner 11 is about to be extinguished. The flame holding body 12 is disposed radially inwardly of the main burner 11, and held by a flame holding body holder member 16. In the embodiment, the flame holding body 12 is a platinum catalyst having a dome-shaped portion. The dome-shaped portion is composed of a mesh, and serves as a gas discharge port (see arrows $f_2$ in FIG. 3). The openings of the mesh are preferably within the range of 0.01 mm or more and 2 mm or less in size, and in the embodiment, about 0.24 mm in size.

Combustion by the flame holding body 12 is basically nameless catalytic combustion, but normal combustion that accompanies flames, as in the main burner 11, also occurs concurrently.

Through the gas supply pipe 13, combustion gas is fed from a gas container 17 filled with the combustion gas to the main burner 11 and the flame holding body 12. The gas supply pipe 13 is connected to a first intake pipe 18 for feeding the gas to the main burner 11, and a second intake pipe 19 for feeding the gas to the flame holding body 12. The first intake pipe 18 is a cylindrical member having a closed bottom, and the second intake pipe 19 is inserted through the first intake pipe 18 so as to be coaxial with the first intake pipe 18.

Air holes 20 are formed both in the closed bottom surface of the first intake pipe 18 and in the side surface of the second intake pipe 19 (see FIG. 3) to draw air for combustion into the respective pipes 18 and 19. However, the air holes 20 formed in the first intake pipe 18 may be omitted. This is because, in order to produce, by the main burner 11, a flame that can be clearly seen, combustion by the main burner 11 has to be, as explained above, slightly incomplete, and to that end, it may not be necessary to deliberately draw air through the air holes 20.

The first intake pipe 18 has the first nozzles 21, while the second intake pipe 19 has a second nozzle 22, and gas is injected through the respective nozzles 21 and 22 at predetermined rates. As gas is injected through the respective nozzles 21 and 22, air is drawn through the air holes 20 such that the air drawn through the air holes 20 of the intake pipe 18 and the air drawn through the air holes 20 of the intake pipe 19 are mixed with the gases injected through the respective nozzles 21 and 22 to form gas-air mixtures. The gas injection rates through the first nozzles 21 and the second nozzle 22 are different from each other, and the air holes 20 formed in the first intake pipe 18 are different in size from the air holes 20 formed in the second intake pipe 19, such that gas-air mixtures having different gas concentrations that are suitable for combustion by the main burner 11 and the flame holding body 12 are fed to the main burner 11 and the flame holding body 12, respectively.

In the embodiment, the first intake pipe 18 is a cylindrical member, and five first nozzles 21 are disposed on the first cylindrical intake pipe 18 at equal intervals in the circumferential direction of the first intake pipe 18. By providing a plurality of first nozzles 21, a gas-air mixture can be uniformly discharged from the main burner 11, thus ensuring stable combustion. Also, by providing a plurality of first nozzles 21, wind resistance and rain resistance improve. The number of the first nozzle(s) is not limited to five, and may be changed if appropriate.

Disposed at the outlet end of the second intake pipe 19 is a dispersing member 26 comprising a dome-shaped metal plate formed with a multitude of punched holes. The dispersing member 26 disperses the gas fed through the second intake pipe 19 over the entire area of the flow passage, thereby allowing the gas to be discharged uniformly from the entire surface of the flame holding body 12 (see arrows $f_2$ in FIG. 3). The dispersing member 26 also prevents the gas in the second intake pipe 19 from getting ignited due to the high temperature of the flame holding body 12.

Disposed at the outlet end of the second intake pipe 19 is a dispersing member 26 comprising a dome-shaped metal plate formed with a multitude of punched holes. The dispersing member 26 disperses the gas fed through the second intake pipe 19 over the entire area of the flow passage, thereby allowing the gas to be discharged uniformly from the entire surface of the flame holding body 12 (see arrows $f_2$ in FIG. 3). The dispersing member 12 also prevents the gas in the second intake pipe 19 from getting ignited due to the high temperature of the flame holding body 12.

This torch 10 has an advantage in that, even if, on rare occasions, the flame produced by the main burner 11 is about to be extinguished by wind and/or rain, the flame holding body 12 maintains the combustion state of the main burner 11.

The gas discharge port of the flame holding body 12 is formed by a dome-shaped mesh, so that rainwater that may reach the gas discharge port is prevented from entering the gas discharge port, due to the surface tension of the rainwater. This allows stable combustion by the flame holding body 12. Moreover, since the gas discharge port of the flame holding body 12 is heated to high temperature due to catalytic combustion by the flame holding body 12, water vaporizes at the surface of the gas discharge port, and does not directly contact the gas discharge port. This more reliably prevents entry of water into the gas discharge port.

Since the flame holding body 12 has a dome shape, even if horizontal wind in one direction toward the flame holding body 12 temporarily lowers the temperature of the flame holding body 12 at its windward side, thus partially stopping catalytic combustion, the catalytic combustion is not impacted by the wind, and maintained, at the leeward side of the flame holding body 12. The dome shape thus prevents the catalytic combustion by the flame holding body 12 from being stopped altogether by wind.

Since a platinum catalyst is used as the flame holding body 12, the flame holding body 12 emits bright light (near-white orange colored light). Spectators can see such bright light at the tips of two torches 10 held by two torch runners during the torch kiss, i.e., when the flame is transferred from one torch to the other, making the event more dramatic.

Metals or metallic compounds may be disposed in the vicinity of the flame holding body 12, or sprayed onto the flame holding body 12, thus producing a dramatic effect by light due to flame reaction (by, e.g., producing lights corresponding, respectively, to the five Olympic colors). Also, to enhance the dramatic effect by light while a torch runner is running with the torch, a through hole (not shown) may be formed in the torch body 25 such that spectators can see the light produced by the flame holding body 12 through the through hole.

Figure 5:
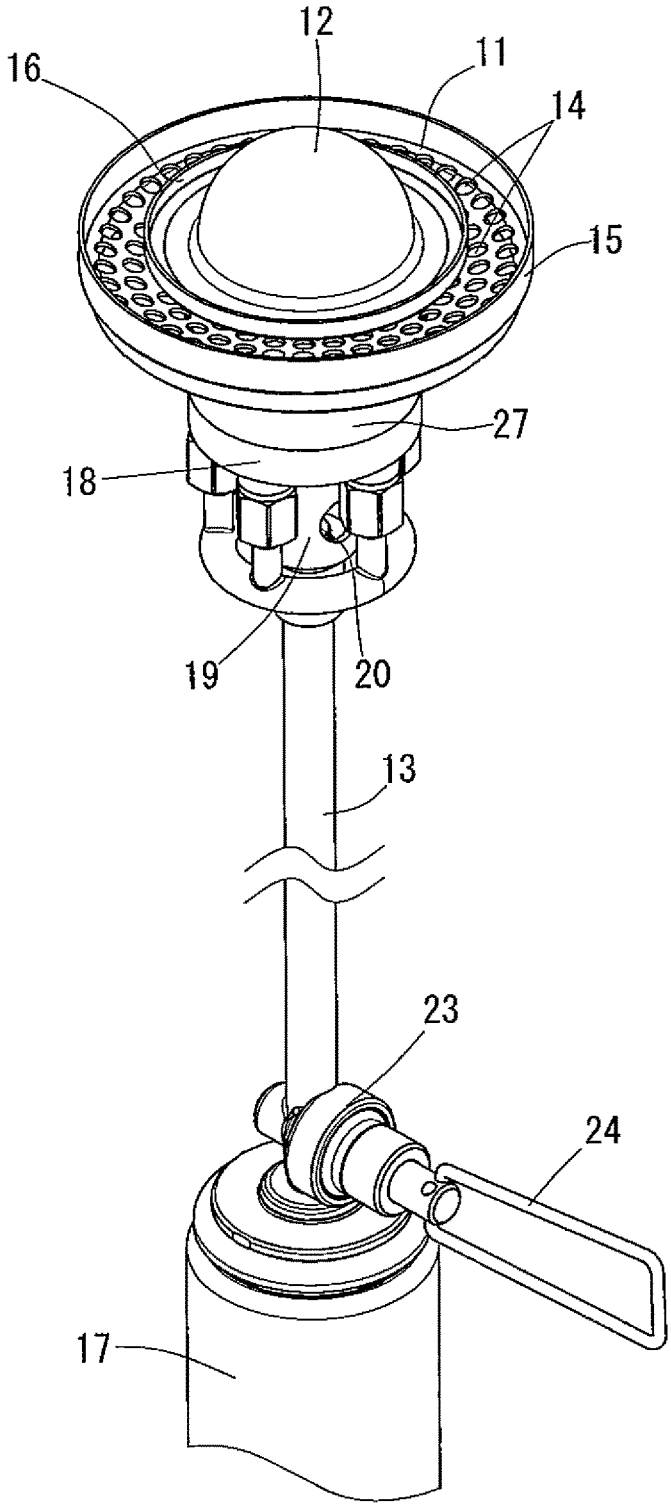
FIG. 5 is a perspective view of a torch according to a second embodiment of the present invention, illustrating the interior structure thereof.
Figure 6:
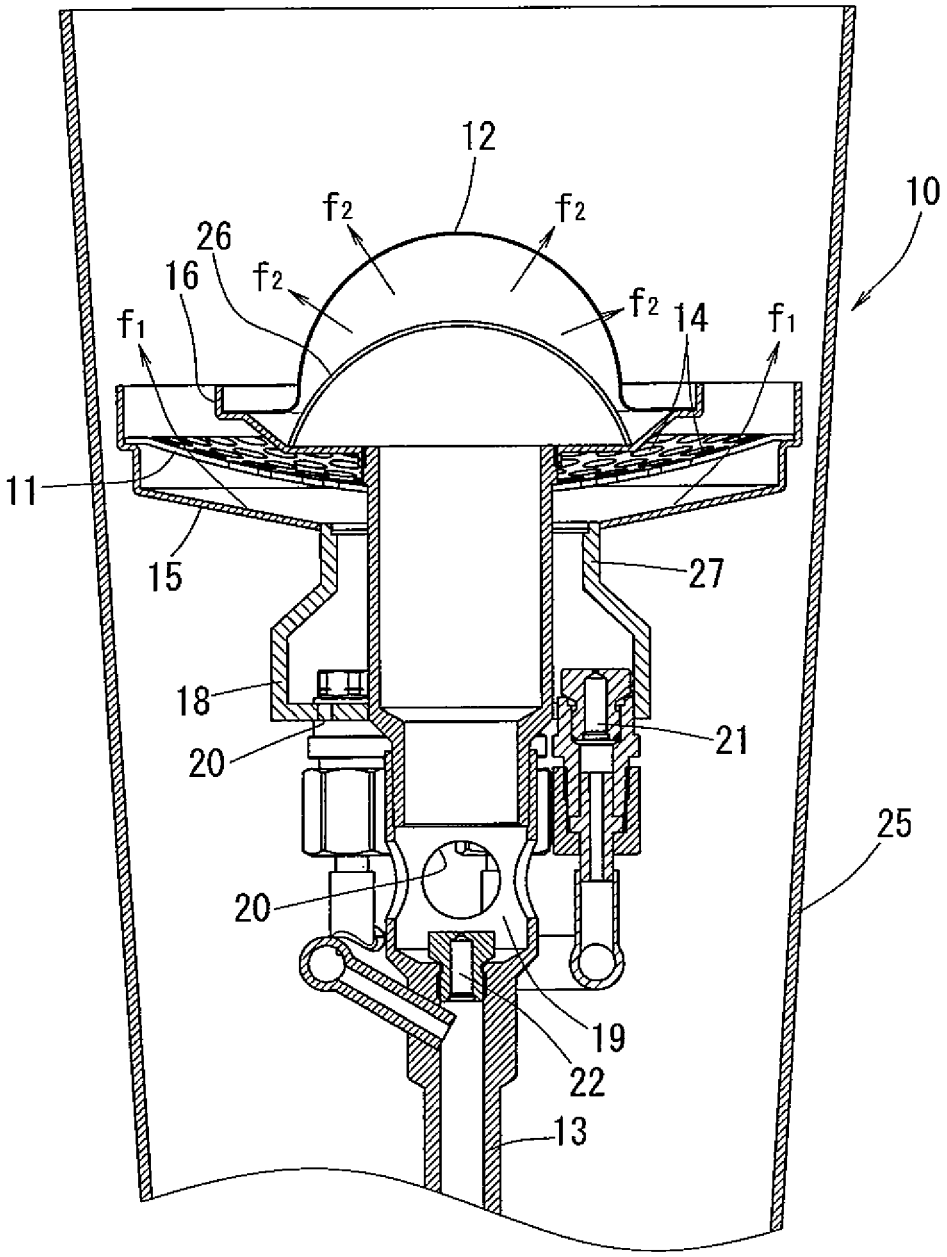
FIG. 6 is a sectional view of a portion of the torch shown in FIG. 5.

FIGS. 5 and 6 show the torch 10 according the second embodiment of the present invention. In the description of the second embodiment (as well as of the subsequent third to sixth embodiments), only what differs from the torch 10 of the first embodiment is described, and elements and portions that are identical or similar to those of the first embodiment are denoted by the same numerals and their description is omitted.

The torch 10 of the second embodiment differs in the structure of the first intake pipe 18, from the torch 10 of the first embodiment. In particular, in the second embodiment, the first intake pipe 18, for feeding gas to the main burner 11, includes, at its end connected to the main burner 11, a small diameter portion 27 of which the cross-section perpendicular to the gas flow direction in the first intake pipe 18 is smaller in area than that of the remaining portion of the first intake pipe 18.

By the provision of the small diameter portion 27, the flow speed of gas increases in the small diameter portion 27, of which the cross-sectional area is smaller than the remaining portion of the first intake pipe 18, and the gas is discharged through the burner ports 14 of the main burner 11 while maintaining its high flow speed. Thus, during a torch relay in a rainy weather, rainwater that may reach the main burner 11 is blown away by the gas discharged through the burner ports 14 at high speed, thereby preventing the flame from being extinguished by the rainwater.

Figure 7:
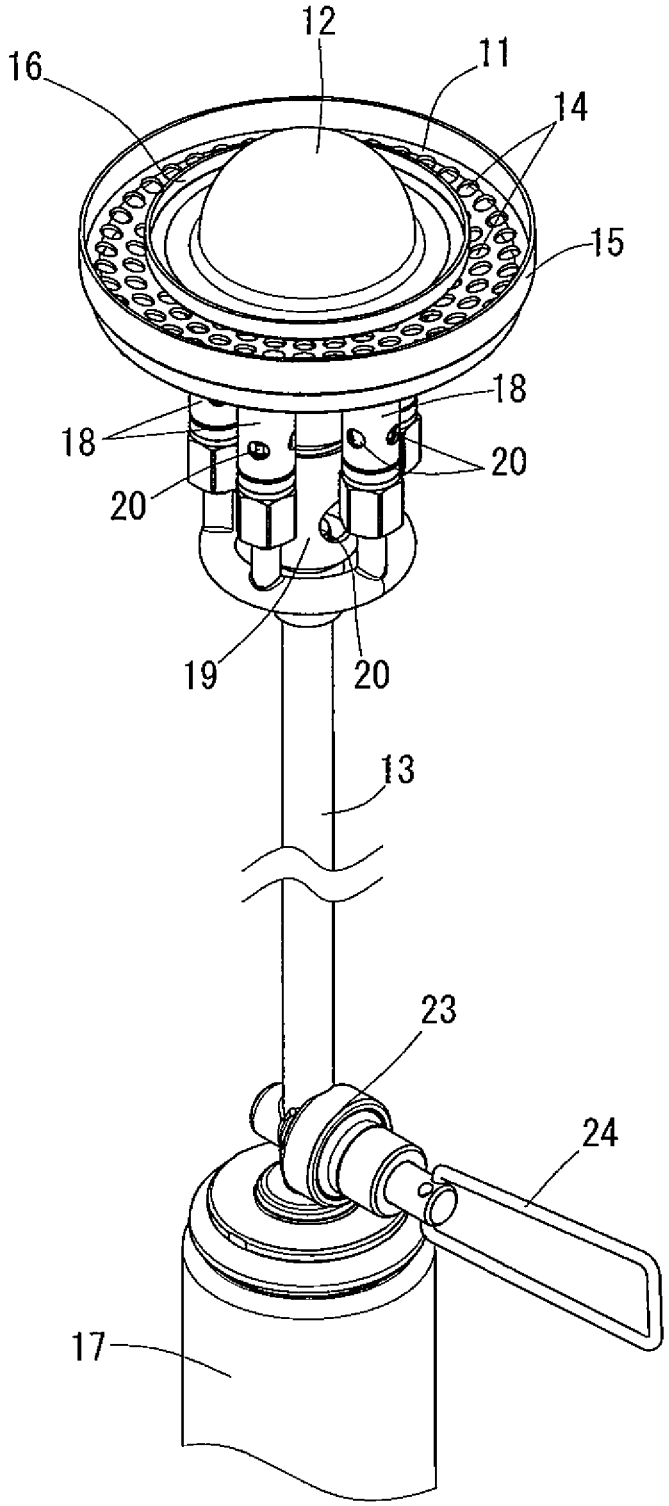
FIG. 7 is a perspective view of a torch according to a third embodiment of the present invention, illustrating the interior structure thereof.
Figure 8:
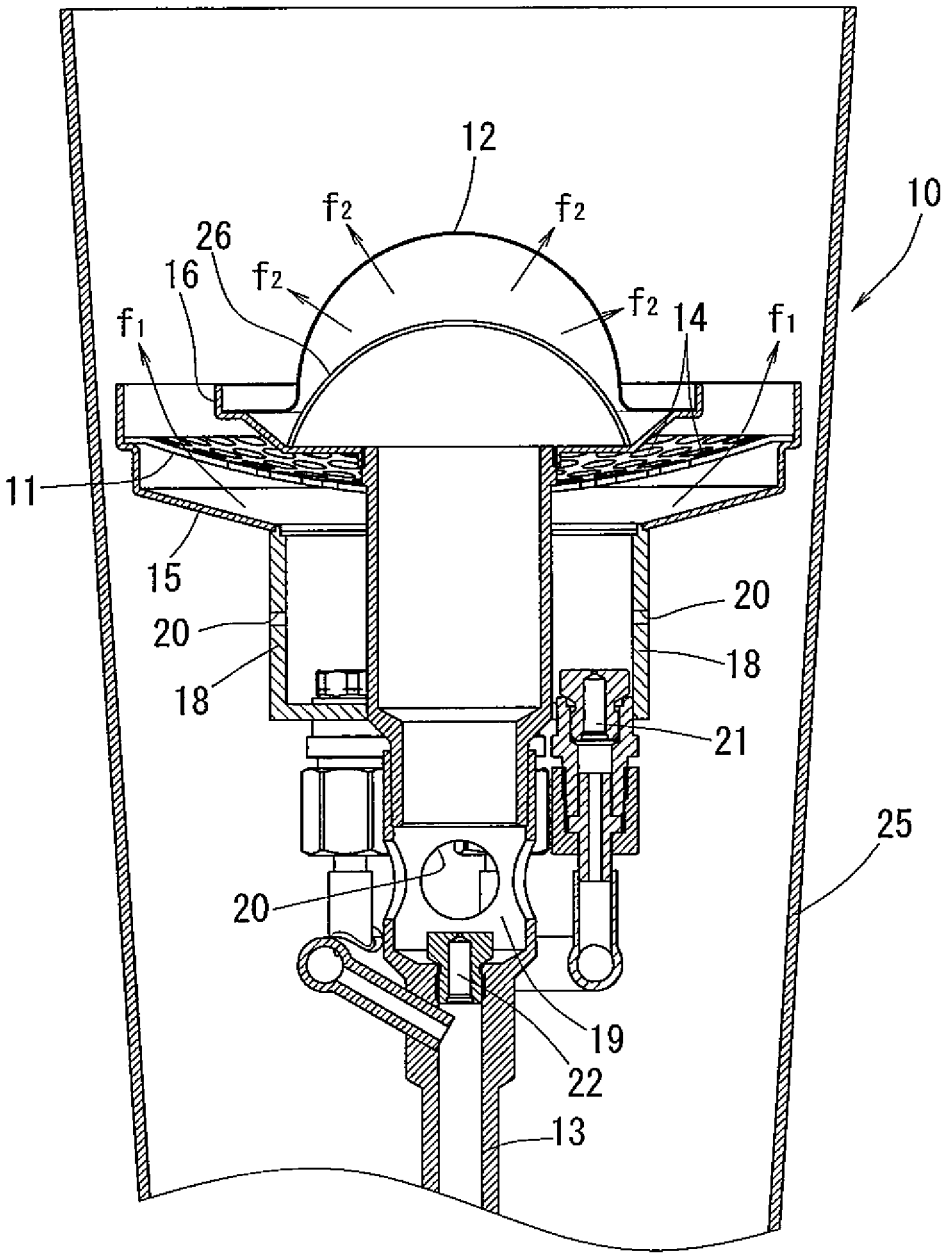
FIG. 8 is a sectional view of a portion of the torch shown in FIG. 7.

FIGS. 7 and 8 show the torch 10 of the third embodiment. The torch 10 of the third embodiment differs from the torch of the first embodiment in that, instead of the single first intake pipe 18, a plurality of (five in the example shown) first intake pipes 18 are separately provided, each having a first nozzle 21. Air holes 20 are formed in the side wall of each first intake pipe 18.

In this arrangement too, as with the torch 10 of the first embodiment, a gas-air mixture can be uniformly discharged from the main burner 11, thus ensuring stable combustion. The number of the first intake pipes 18 (and thus the number of the first nozzles 21) is not limited to five, and may be changed if appropriate.

Figure 9:
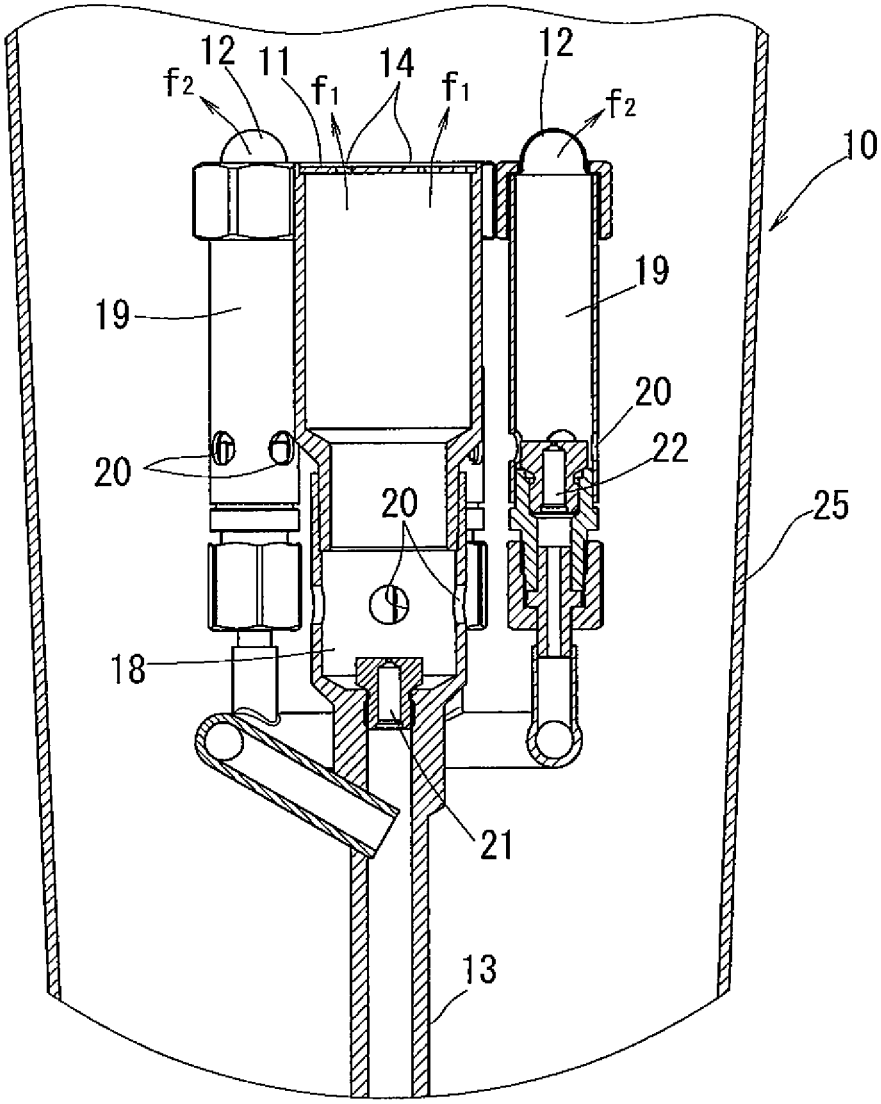
FIG. 9 is a sectional view of a portion of a torch according to a fourth embodiment of the present invention.
Figure 10:
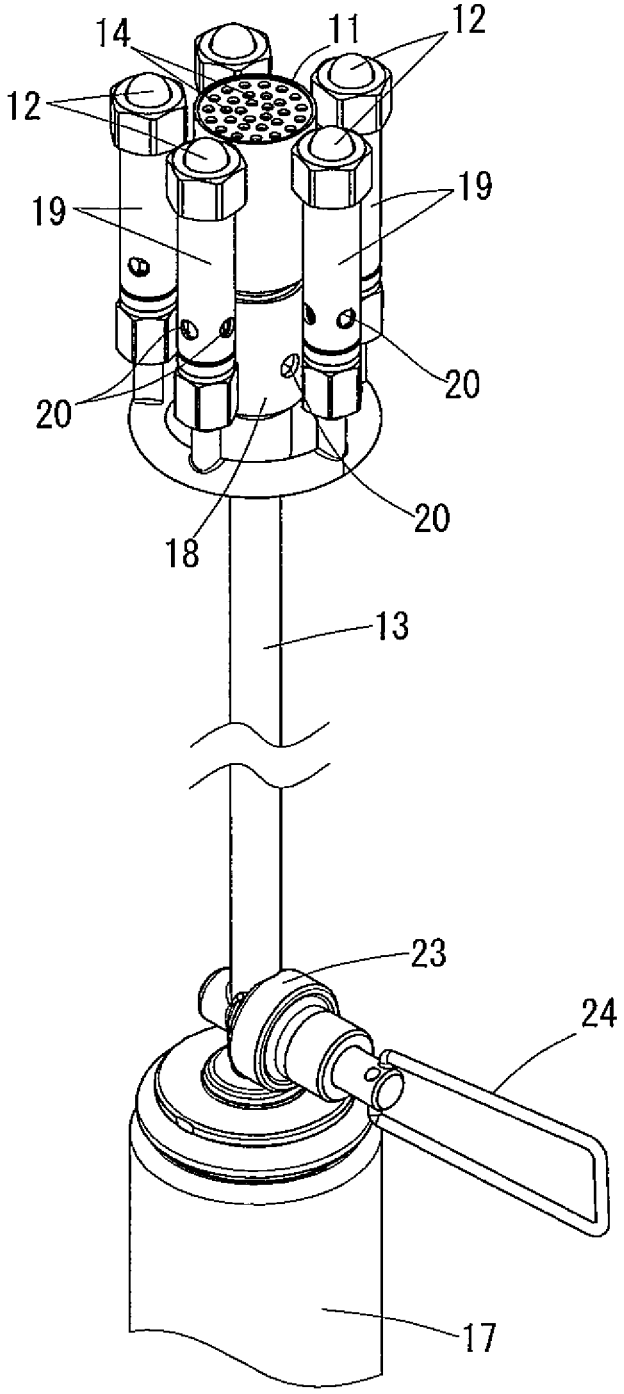
FIG. 10 is a perspective view of the torch shown in FIG. 9, illustrating the interior structure thereof.

FIGS. 9 and 10 show the torch 10 according to the fourth embodiment of the present invention. The torch 10 of the fourth embodiment differs, in the positional relationship between the main burner 11 and the flame holding body 12, from the torch 10 of the first embodiment. In particular, in the fourth embodiment, five flame holding bodies 12 are disposed around the main burner 11 at circumferentially equal intervals so as to surround the main burner 11. The main burner 11 is cylindrical in shape, and has a plurality of burner ports 14 in its top end. Each flame holding body 12 is composed of a dome-shaped platinum catalyst. Gas is supplied to the respective second intake pipes 19 through an annular portion surrounding a lower portion of the main burner 11.

The number and arrangement of the flame holding bodies 12 may be changed, provided the flame holding bodies 12 are capable of reliably maintaining the flame produced by the main burner even if the flame is about to be extinguished.

Figure 11:
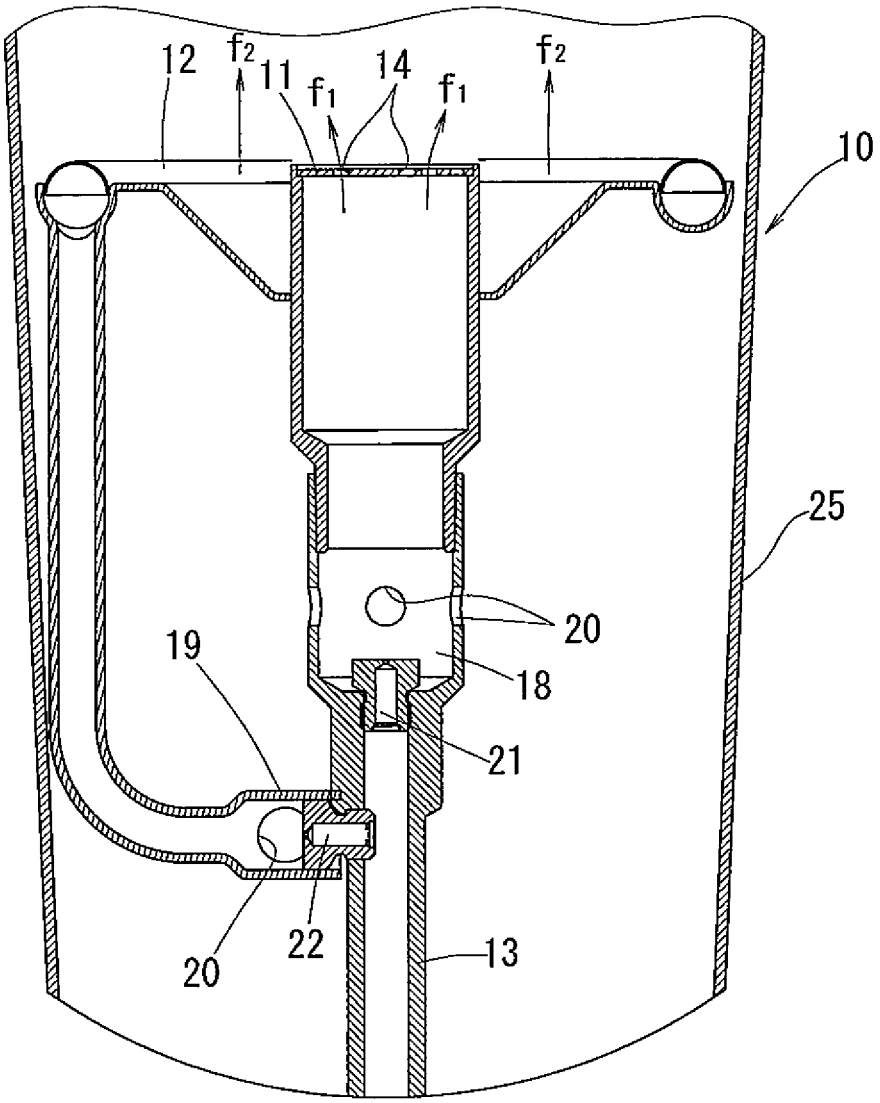
FIG. 11 is a sectional view of a portion of a torch according to a fifth embodiment of the present invention.
Figure 12:
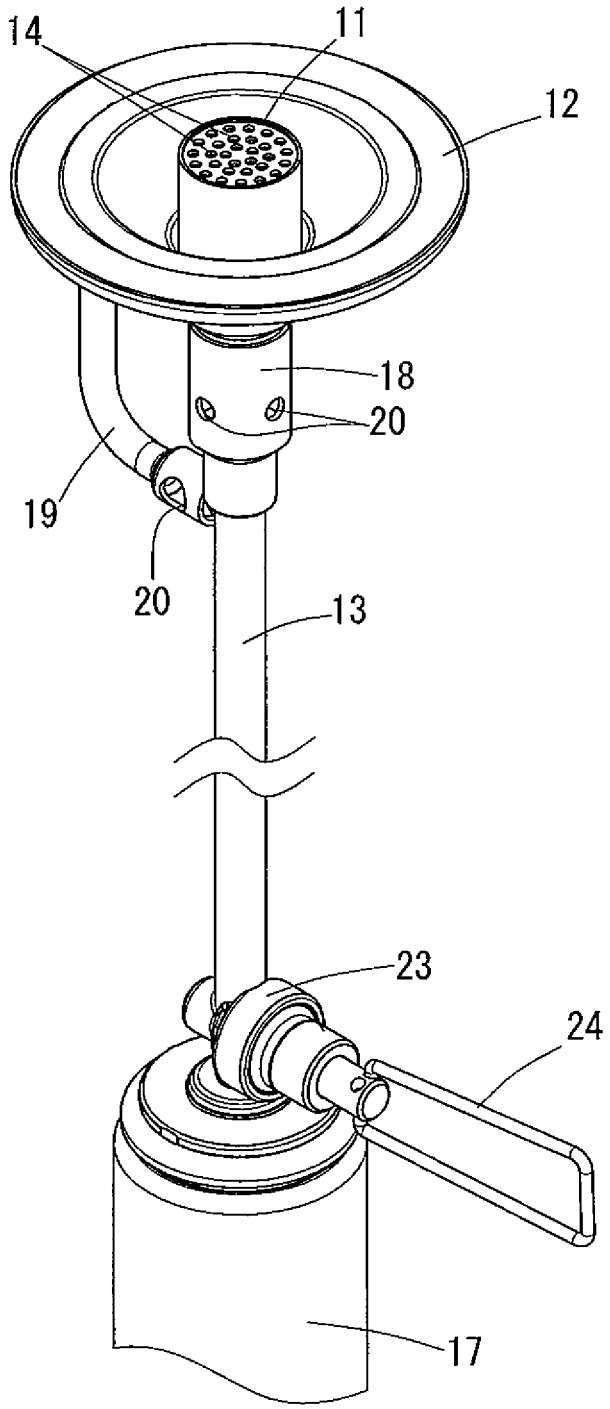
FIG. 12 is a perspective view of the torch shown in FIG. 11, illustrating the interior structure thereof.

FIGS. 11 and 12 show the torch 10 of the fifth embodiment of the present invention. In this embodiment, instead of the plurality of flame holding bodies of the fourth embodiment, a single flame holding body 12 is used. This single flame holding body 12 is similar to the flame holding bodies 12 of the fourth embodiment in that it is composed of a platinum catalyst and disposed around the main burner 11, but differs therefrom in that the single flame holding body 12 of the fifth embodiment has an annular shape and surrounds the main burner 11. Since this flame holding body 12 has an annular shape, it can more reliably and smoothly reignite the main burner 11 if the flame of the main burner 11 is about to be extinguished.

Figure 13:
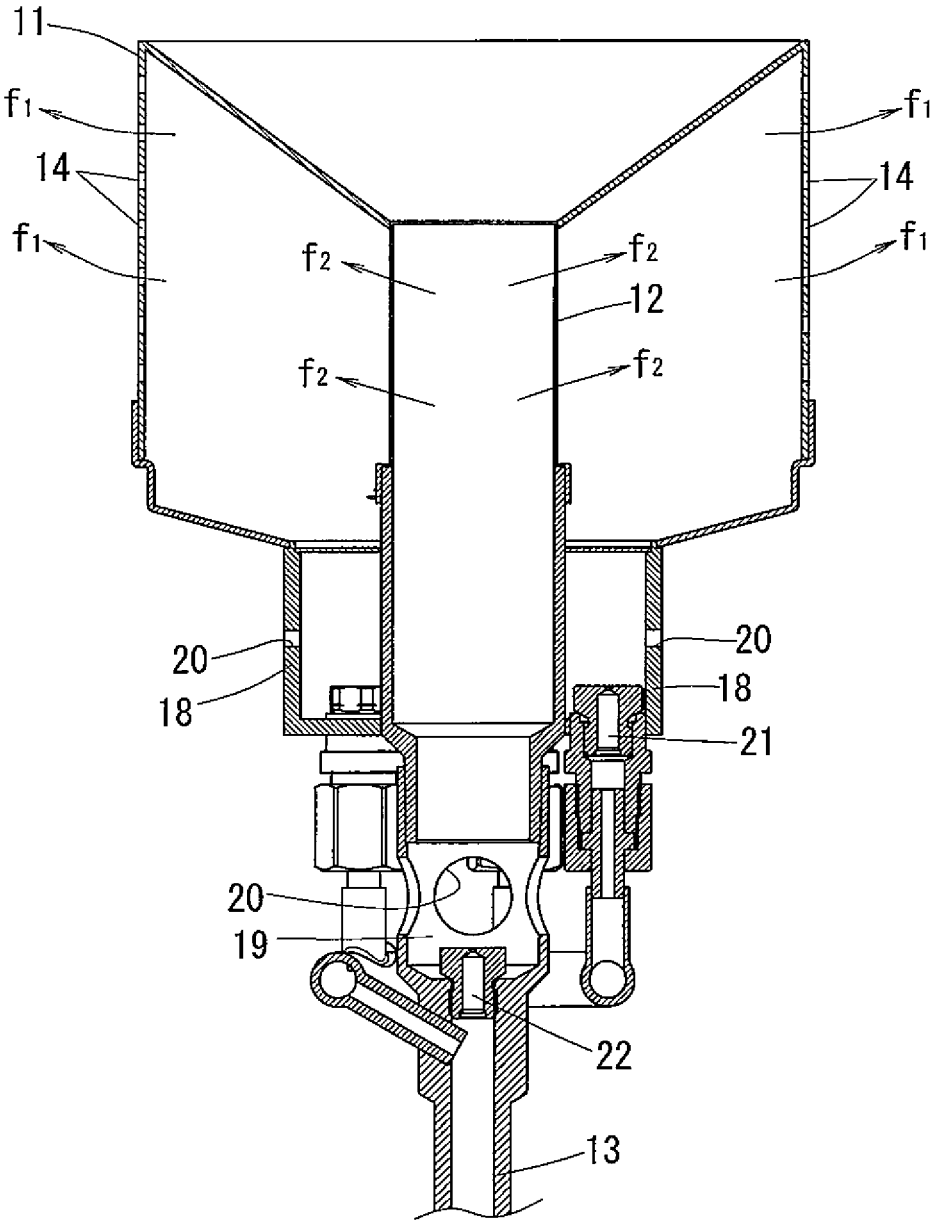
FIG. 13 is a sectional view of a portion of a torch according to a sixth embodiment of the present invention.

FIG. 13 shows the torch 10 according to the sixth embodiment of the present invention. The torch 10 of the sixth embodiment differs from the torch 10 of any of the previous embodiments in that a flame holding body 12 is disposed within the main burner 11. This flame holding body 12 is a cylindrical member having its cylindrical surface constituted by a mesh of a platinum catalyst. The main burner 11, which is disposed around the flame holding body 12, is also a cylindrical member, and a plurality of burner ports 14 are formed in the cylindrical surface thereof. Such a flame holding body 12, i.e., a flame holding body disposed within the main burner 11, is also capable of reliably maintaining the combustion state of the main burner 11 whenever the flame is about to be extinguished.

The embodiments are mere examples in every respect, and the materials, shapes, numbers and arrangements of the constituent parts of the torch of any embodiment may be altered, provided the object of the present invention is achieved, i.e., if it is possible to positively prevent the torch flame from being extinguished by wind and/or rain, while providing a dramatic impression by the flame produced.

For example, in any of the embodiments, the flame holding body (or bodies) may be made of a catalyst other than platinum, such as palladium, ruthenium, rhodium or silver. The flame holding body (bodies) is not even limited to a catalyst material, and may be a metal (such as stainless steel) net or a honeycomb-shaped ceramic member. This is because, although these materials do not have catalytic properties, they glow due to normal combustion of gas, thereby performing the function of maintaining the combustion state of the main burner 11 whenever the flame produced by the main burner 11 is about to be extinguished. The flame holding body (bodies) may comprise a metal or ceramic base, and a catalyst, such as platinum, supported on the base.

Still alternatively, as the flame holding body (or bodies) 12, an inner flame burner (or burners), which is less affected by wind and/or rain, may be used. In order to reliably maintain the combustion state of the flame holding body (bodies) 12 itself, the torch may include a windshield member of a size that does not hide the flame produced by the main burner 11. While the shape of the flame holding body (bodies) 12 is not limited to a dome shape or a cylindrical shape, a shape should be selected that allows maximum dispersion of wind forces, for example, a hemicylindrical shape (having a circumferential angle of 180° in plan view) may be selected.

DESCRIPTION OF THE REFERENCE SYMBOLS

10. Torch
11. Main burner
12. Flame holding body
13. Gas supply pipe
14. Burner port
15. Main burner holder member
16. Flame holding body holder member
17. Gas container
18. First intake pipe
19. Second intake pipe
20. Air hole
21. First nozzle
22. Second nozzle
23. Valve
24. Operation handle
25. Torch body
26. Dispersing member
27. Small diameter portion

What is claimed is:

1. A torch comprising:
a main burner that produces a flame;
a flame holding body configured to maintain a combustion state of the main burner if the flame produced by the main burner is about to be extinguished; and
a gas supply pipe configured to feed combustion gas from a gas container filled with the combustion gas to the main burner and the flame holding body;
wherein the flame holding body includes a catalyst that produces catalytic combustion of gas to prevent the flame from being extinguished.

2. The torch of claim 1, wherein the catalyst contains at least one of platinum, palladium, ruthenium, rhodium and silver.

3. The torch of claim 2, wherein the flame holding body has a gas discharge port formed by a mesh having openings of 0.01 mm or more and 2 mm or less in size.

4. The torch of claim 3, wherein the gas discharge port of the flame holding body has a three-dimensional shape.

5. The torch of claim 4, wherein the gas feed pipe is connected to the first intake pipe, and to a second intake pipe that feeds gas to the flame holding body, such that either (i) mixtures of gas and air having different gas concentrations from the first intake pipe and the second intake pipe, or (ii) only gas from the first intake pipe and a mixture of gas and air from the second intake pipe, can be fed to the main burner and the flame holding body, respectively.

6. The torch of claim 3, wherein the gas feed pipe is connected to a first intake pipe that feeds gas to the main burner, and to a second intake pipe that feeds gas to the flame holding body, such that either (i) mixtures of gas and air having different gas concentrations from the first intake pipe and the second intake pipe, or (ii) only gas from the first intake pipe and a mixture of gas and air from the second intake pipe, can be fed to the main burner and the flame holding body, respectively.

7. The torch of claim 2, wherein the gas discharge port of the flame holding body has a three-dimensional shape.

8. The torch of claim 2, wherein the gas feed pipe is connected to a first intake pipe that feeds gas to the main burner, and to a second intake pipe that feeds gas to the flame holding body, such that either (i) mixtures of gas and air having different gas concentrations from the first intake pipe and the second intake pipe, or (ii) only gas from the first intake pipe and a mixture of gas and air from the second intake pipe, can be fed to the main burner and the flame holding body, respectively.

9. The torch of claim 1, wherein the flame holding body has a gas discharge port formed by a mesh having openings of 0.01 mm or more and 2 mm or less in size.

10. The torch of claim 9, wherein the gas feed pipe is connected to a first intake pipe that feeds gas to the main burner, and to a second intake pipe that feeds gas to the flame holding body, such that either (i) mixtures of gas and air having different gas concentrations from the first intake pipe and the second intake pipe, or (ii) only gas from the first intake pipe and a mixture of gas and air from the second intake pipe, can be fed to the main burner and the flame holding body, respectively.

11. The torch of claim 1, wherein the gas discharge port of the flame holding body has a three-dimensional shape.

12. The torch of claim 11, wherein the gas feed pipe is connected to the first intake pipe, and to a second intake pipe that feeds gas to the flame holding body, such that either (i) mixtures of gas and air having different gas concentrations from the first intake pipe and the second intake pipe, or (ii) only gas from the first intake pipe and a mixture of gas and air from the second intake pipe, can be fed to the main burner and the flame holding body, respectively.

13. The torch of claim 1, further comprising an intake pipe for feeding gas to the main burner, the intake pipe including, at an end thereof connected to the main burner, a small diameter portion of which a cross-section perpendicular to a gas flow direction in the intake pipe is smaller in area than a corresponding cross-section of a remaining portion of the intake pipe.

14. The torch of claim 1, wherein the gas feed pipe is connected to a first intake pipe that feeds gas to the main burner, and to a second intake pipe that feeds gas to the flame holding body, such that either (i) mixtures of gas and air having different gas concentrations from the first intake pipe and the second intake pipe, or (ii) only gas from the first intake pipe and a mixture of gas and air from the second intake pipe, can be fed to the main burner and the flame holding body, respectively.

15. A torch comprising:

a main burner that produces a flame;

a flame holding body configured to maintain a combustion state of the main burner if the flame produced by the main burner is about to be extinguished; and a gas supply pipe configured to feed combustion gas from a gas container filled with the combustion gas to the main burner and the flame holding body, wherein the gas feed pipe is connected to a first intake pipe that feeds gas to the main burner, and to a second intake pipe that feeds gas to the flame holding body, such that either (i) mixtures of gas and air having different gas concentrations from the first intake pipe and the second intake pipe, or (ii) only gas from the first intake pipe and a mixture of gas and air from the second intake pipe, can be fed to the main burner and the flame holding body, respectively.

16. The torch of claim 15, wherein the flame holding body has a gas discharge port formed by a mesh having openings of 0.01 mm or more and 2 mm or less in size.

17. The torch of claim 15, wherein the gas discharge port of the flame holding body has a three-dimensional shape.

* * * * *